United States Patent [19]

Andres

[11] 4,253,647

[45] Mar. 3, 1981

[54] SLIDE GATE NOZZLE FOR LADLES

[75] Inventor: Adolf Andres, Schwalbach, Fed. Rep. of Germany

[73] Assignee: Stahlwerke Röchling-Burbach Gesellschaft mit beschränkter Haftung, Völklingen-Saar, Fed. Rep. of Germany

[21] Appl. No.: 74,314

[22] Filed: Sep. 11, 1979

[30] Foreign Application Priority Data

Sep. 15, 1978 [DE] Fed. Rep. of Germany ..... 2840171

[51] Int. Cl.[3] ..... C21C 5/48

[52] U.S. Cl. ..... 266/271; 266/236

[58] Field of Search ..... 266/236, 271

[56] References Cited

U.S. PATENT DOCUMENTS 3,398,945 8/1968 Walpole ..... 266/236

3,436,023 4/1969 Thalmann ..... 266/236

4,093,452 6/1978 Spenceley ..... 75/60

*Primary Examiner*—P. D. Rosenberg

*Attorney, Agent, or Firm*—Toren, McGeady and Stanger

[57] ABSTRACT

A closure arrangement for a ladle or similar container having an opening in its bottom includes a bottom block arranged in the bottom opening, and a kidney-shaped refractory closing member seated in a plate at the bottom of the ladle to confront the bottom block. A cantilever frame is pivotally mounted at the bottom of the ladle for swinging movement relative to the closing member, and a kidney-shaped refractory sliding member is arranged in the frame for discharging the molten metal when the sliding member is moved to one or more selected positions relative to the closing member. A pressure plate associated with the frame urges a sealing surface on the sliding member against a sealing surface on the closing member when the frame is swung past the closing member.

7 Claims, 6 Drawing Figures

(a-a)

SLIDE GATE NOZZLE FOR LADLES

BACKGROUND OF THE INVENTION

The invention relates to a closure arrangement for the bottom nozzle of ladles and similar containers containing metal melts, wherein a slide gate is provided which is freely movable parallel relative to the plane of the ladle bottom, the slide gate closing from the outside an outlet opening provided at the bottom of the ladle.

Closure arrangements of this type are known, for example, from German Auslegeschrift No. 12 81 643 and German Offenlegungsschrift No. 24 27 305. In both cases, the swivel arm is supported at its free end. This requires a relatively cumbersome construction. In addition, arrangements of this type are susceptible to trouble which results in increased maintenance costs and, as a result thereof, in increased production costs. In addition, the solution for the arrangement of the refractory parts for the practical operation is either inefficient (German Auslegeschrift No. 12 81 643) or cumbersome, such as, for example, in German Offenlegungsschrift No. 24 27 305. Concerning the latter, it is further noted that the replacement of the inner sleeve seated in the bottom block of the ladle takes a significant amount of time and, in addition, the bottom block is frequently damaged.

The invention is based on the task to provide a closure arrangement of the above-indicated type which is of simple construction and still safe to operate and easy to manipulate.

In accordance with the invention, this task is solved thereby that a kidney-shaped cantilever swivel frame is provided which has a correspondingly constructed refractory sliding member, and that a closing member is arranged in a kidney-shaped drawing-off plate, the closing member being constructed simultaneously as the inner sleeve for the bottom block of the ladle and as a stationary refractory unit.

In accordance with an embodiment of the invention, the closing member is placed in the bottom block of the ladle in such a manner that a horizontally extending gap exists between the bottom block and the closing member.

Another embodiment of the invention resides in that the opening in the bottom block has a larger cross section than the opening of the closing member.

The advantages achieved by means of the invention reside particularly in the fact that the new closure arrangement is relatively inexpensive with respect to procurement and production and with respect to maintenance and operation. In addition, it is possible to exchange the refractory parts quickly and without problems. Furthermore, the arrangement requires little space.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
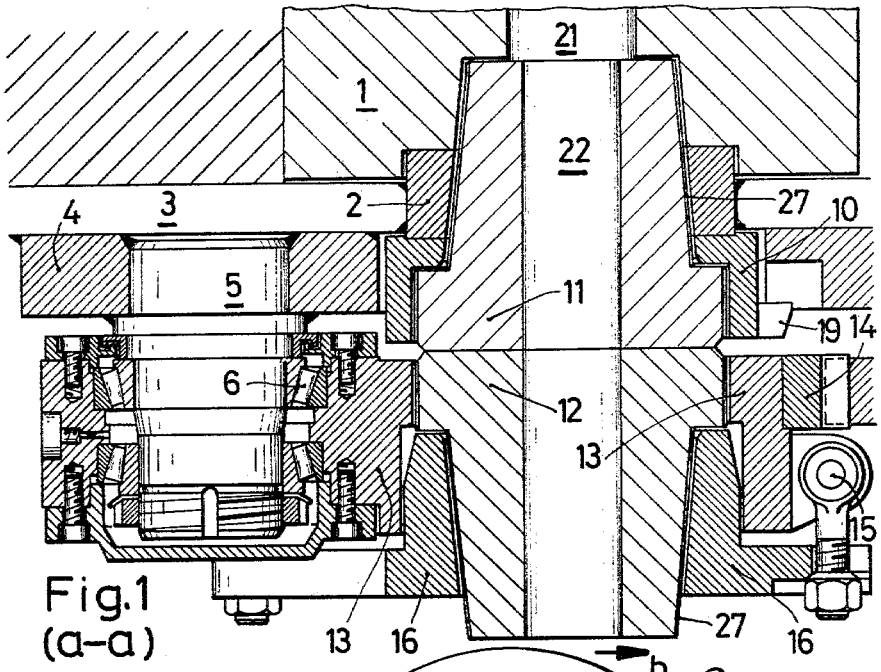
FIG. 1 is an elevational sectional view of a closure arrangement according to the present invention.

Reference numeral 1 denotes the bottom block which is arranged in the bottom, for example, of a ladle. Reference numeral 2 denotes a centering ring which is arranged in the bottom plate 3 of the ladle. Reference numeral 4 denotes the base plate which belongs to the closure arrangement and is rigidly connected to the bottom plate 3, for example, by means of welding.

Figure 2:
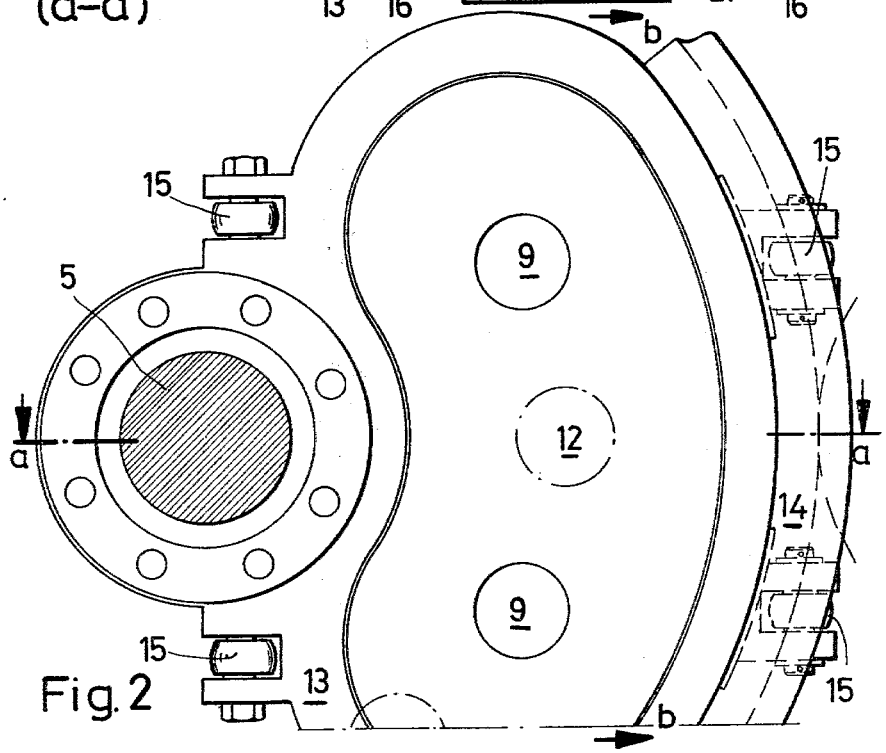
FIG. 2 is a plan view of a portion of the closure arrangement of FIG. 1.
Figures 2, 3:
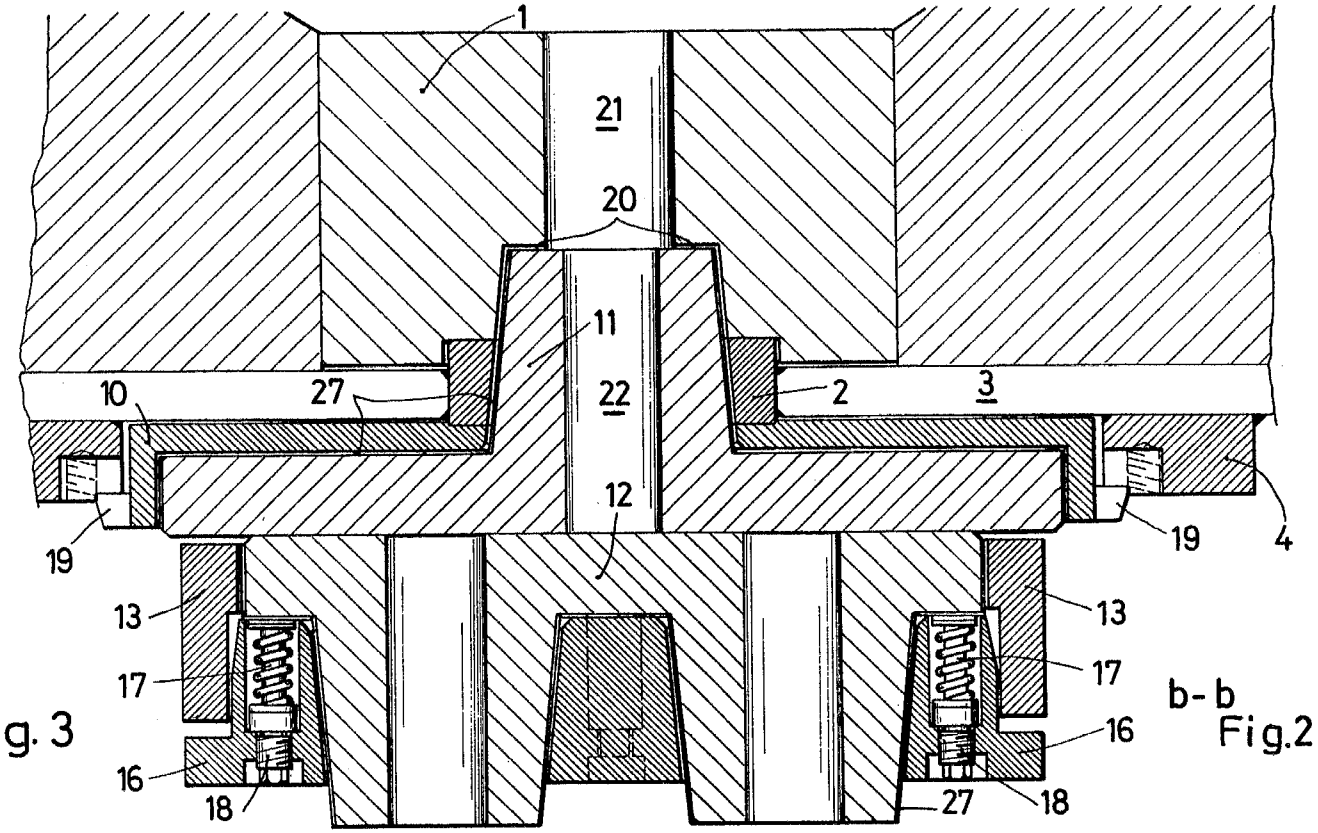
FIG. 3 is an elevational sectional view taken along line b—b in FIG. 2.

The kidney-shaped swivel frame 13 is supported on a pivot pin 5 by means of friction or roller bearings 6. FIGS. 1, 2 and 3 show that the swivel frame 13 is of the cantilevered type, i.e. it is nowhere supported at its free end on the righthand side in FIG. 1. Accordingly, contrary to the known arrangements, with the exception of the friction between the two refractory members 11 and 12, there exists no additional friction, for example, between metallic surfaces and, therefore, there is also no wear and a relatively small force is required to operate the system.

In the illustrated example, the refractory sliding member 12 has two openings 9 which may have equal or different diameters. Of course, only one opening 9 or more than two of these openings may be provided.

The refractory closing member 11 has two purposes: it is the inner sleeve of the bottom block 1 and, simultaneously, the stationary counterpart to the sliding member 12. The closing member 11 is seated in a drawing-off plate 10 which is provided with cams 19 at the periphery. In other words, the conventional inner sleeve is no longer provided as an independent part; its function is assumed partially by the bottom block 1 and partially by the closing member 11.

The two refractory members, the sliding member 12 and the closing member 11, are constructed in the shape of a kidney since this design has been found especially resistant to cracks and because an advantageous sealing surface is obtained between the closing member 11 and the sliding member 12. Consequently, the swivel frame 13 and the drawing-off plate 10 are also kidney-shaped. Advantageously, the sealing surface of the stationary closing member 11 is larger than that of the sliding member 12 in order to ensure a secure sealing, i.e. a good contact during the entire sliding procedure.

It has been found advantageous for many applications to surround the sliding member 12 and particularly the closing member 11 with a jacket 27 of metal, preferably sheet steel. This measure has the advantage that the refractory members are protected against mechanical damage during transport and operation. As far as the closing member 11 is concerned, the jacket 27 of metal also ensures a safe, complete withdrawal from the bottom block 1, a procedure shall be explained in more detail hereinbelow.

In known slide gate closures of various types, between the inner sleeve arranged in the bottom block 1 and the bottom block 1 there exists a gap which extends vertically or almost vertically (German Offenlegungsschrift No. 24 27 305, German Auslegeschrift No. 22 12 312). After teeming several heats, the inner sleeve arranged in the bottom block 1 in this manner is so tight that, as a rule, it is very difficult and very time-consuming to replace the inner sleeve. The bottom block 1 is frequently damaged during this procedure.

Figure 6:
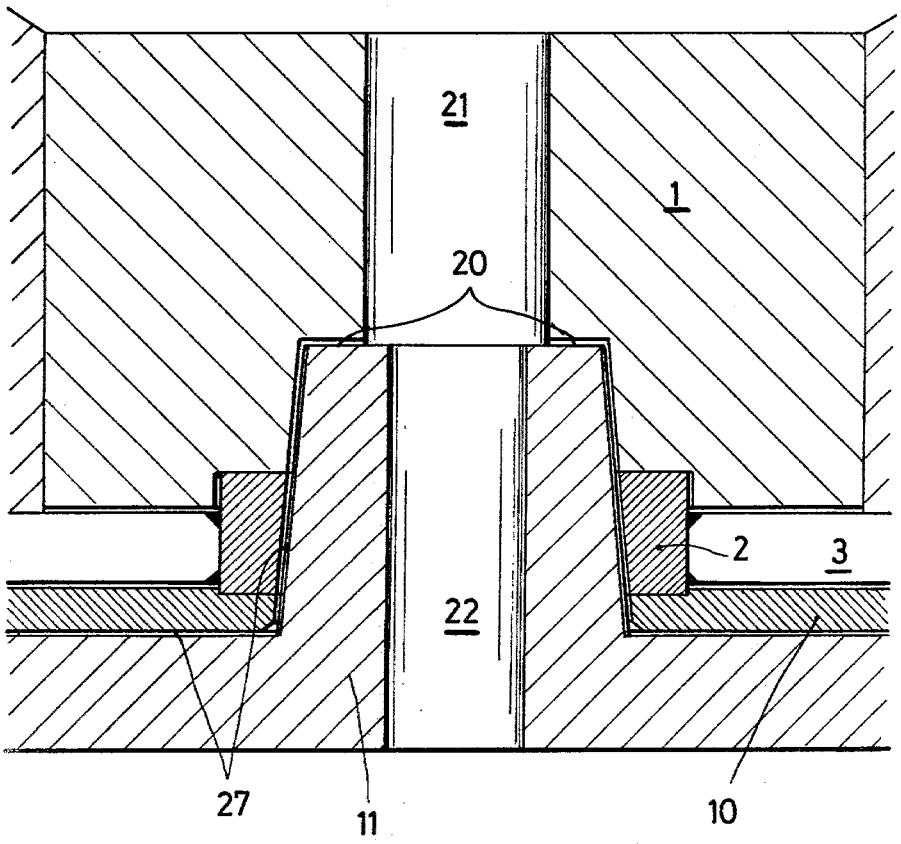
FIG. 6 is an enlarged detail elevational sectional view of the closure arrangement of FIGS. 1–3.

In accordance with a further development of the closure arrangement according to the invention, on the other hand, the closing member 11 is arranged in the bottom block 1 in such a manner that a horizontally extending gap 20 exists on the side of the steel between the bottom block and the closing member 11 (see FIGS. 1, 3 and 6). As a result, the closing member 11 and the bottom block 1 are prevented from "baking together" and the closing member 11 according to the invention can be removed without any risks during the replacement, a procedure which shall be described in more detail hereinbelow.

The aperture 21 in the bottom block 1 may, for example, be of the same size as the opening 22 in the closing member 11 (see FIG. 6). However, it has been found advantageous to select the cross section of the bottom block aperture 21 larger than the largest occurrring cross section of the apertures 22 in the closing member 11 (FIGS. 1 and 3). Tests have shown that, in this manner, a better durability of the unit bottom block/closing member 11 is obtained and that it is easier to withdraw the closing member 11 from the bottom block 1.

By means of a pressure plate 16 and the eye bolts 15, the sliding member 12 is supported in the swivel frame 13 and is pressed against the closing member 11. In the pressure plate 16, compression springs 17 are provided which can be tensioned or retensioned outwardly by means of screws 18. These compression springs 17 have the purpose to compensate dimensional tolerances, so that always an optimum contact pressure exists between sliding member 12 and closing member 11.

A satisfactory surface pressure of the sealing surface between the sliding member 12 and the closing member 11 results from the above-described twofold pressure application of the sliding member 12, on the other hand, (coarsely) by means of eye bolts 15 and, on the other hand, (finely) by means of the compression springs 17. This surface pressure is always equal because the sliding member 12 forms a unit with the corresponding pressure elements 15, 16, 17.

Figure 4:
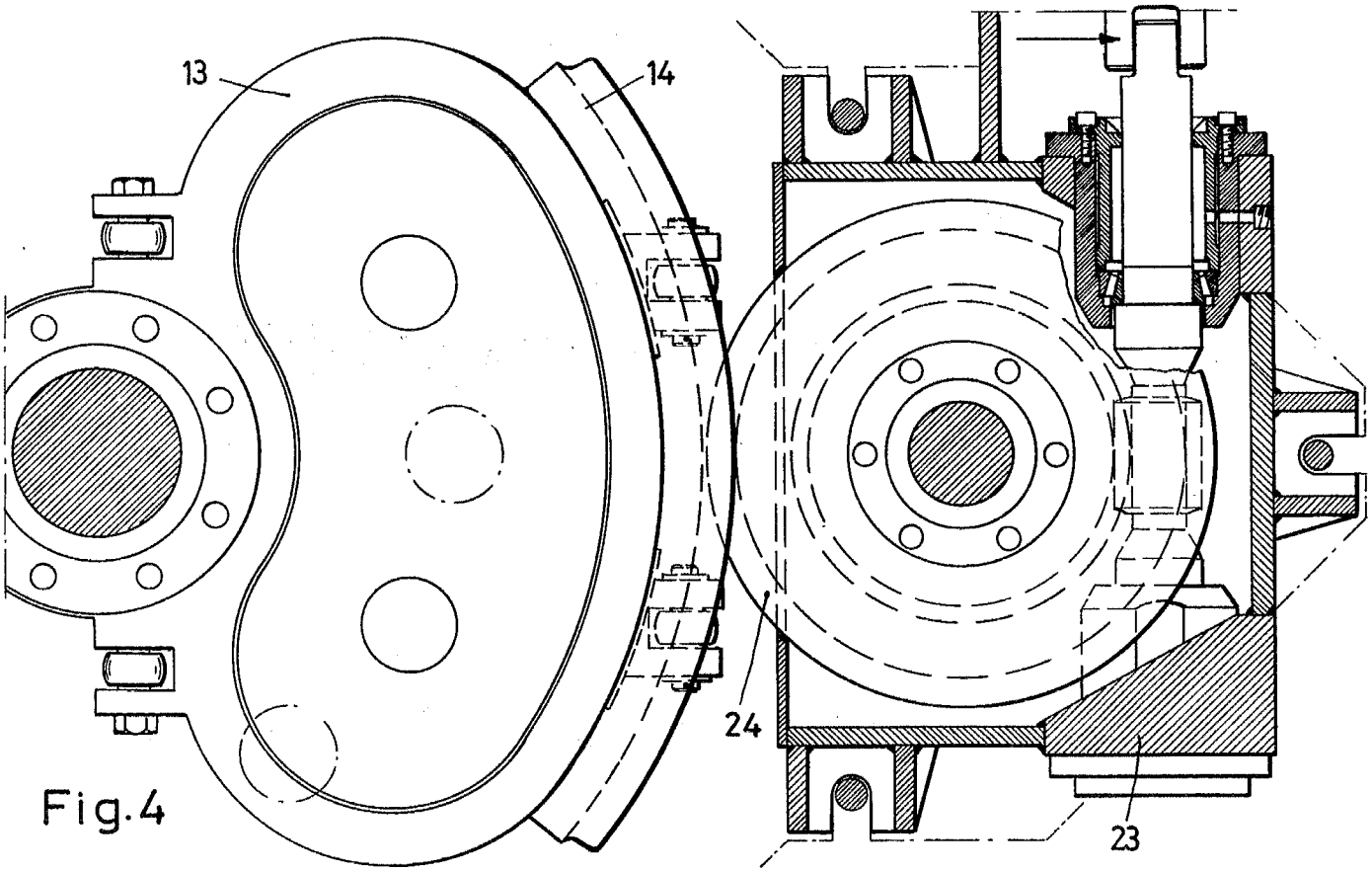
FIG. 4 is a plan view of the closure arrangement as in FIG. 2, further showing a gear system for driving the arrangement.
Figure 5:
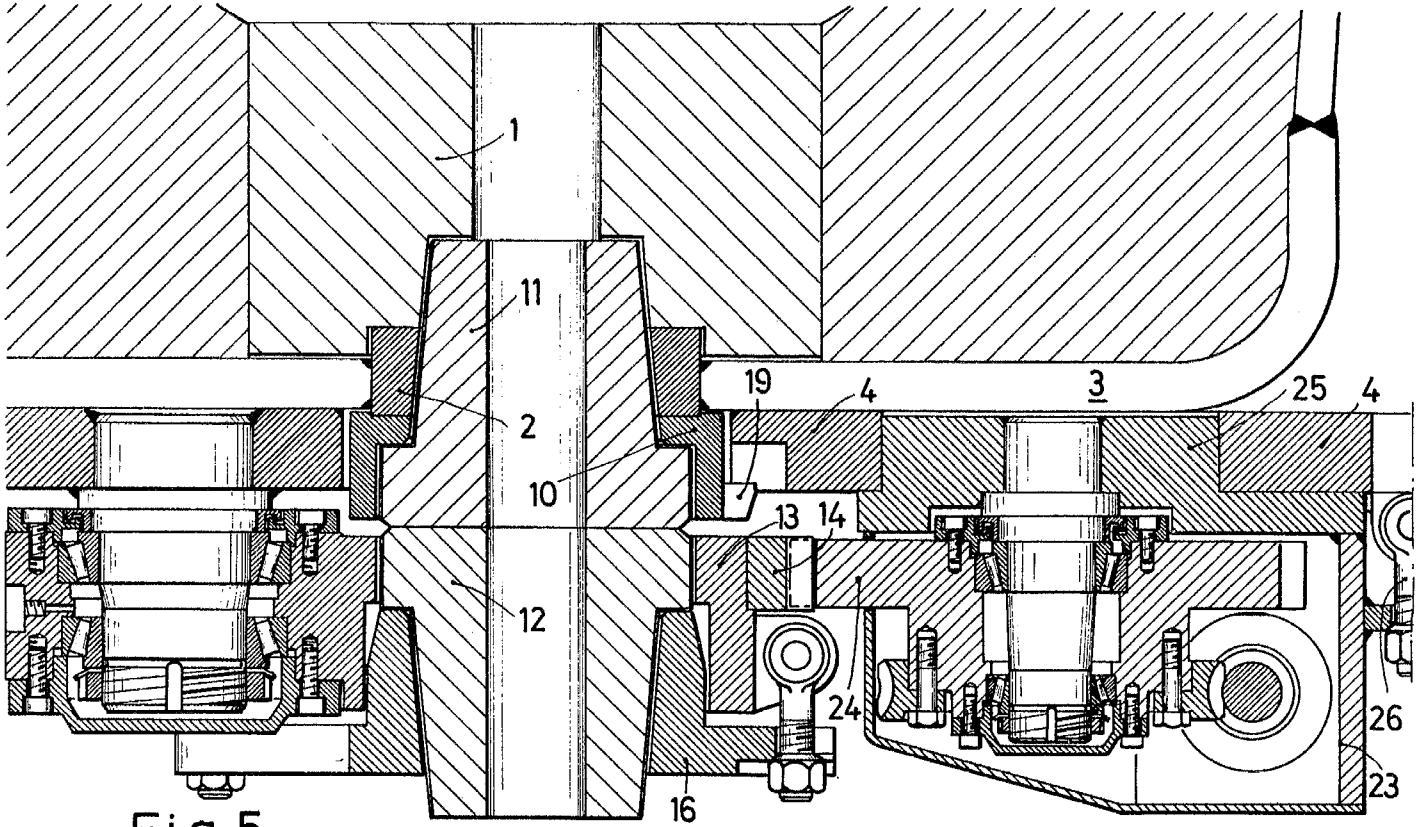
FIG. 5 is an elevational sectional view of the closure arrangement and gear system of FIG. 4.

For closing the apertures 21 and 22, the swivel frame 13 can be moved back and forth by means of any chosen drive. A simple worm gear system 23 driven by a compressed-air motor has been found particularly advantageous (see FIGS. 4 and 5). With a spur gear 24, the worm gear system 23 meshes the toothed segment 14 of the swivel frame 13. Advantageously, the gear system 23 is arranged with its bottom plate 25 in the base plate 4 and is supported by means of screws 26, so that it can be easily taken off the ladle which has significant advantages over most conventional drives which are fixedly arranged on the ladle bottom. The compressed-air motor which, as an example, is used as the drive, is only required for the teeming procedure; for the assembly and disassembly of the wearing parts 11 and 12, it is advantageous to remove the compressed-air motor and to replace it by a simple hand wheel.

In the following, the simple and fast manner of replacing the refractory members, the sliding member 12 and particularly the closing member 11, in the closure arrangement according to the invention is described (FIGS. 1, 2 and 3): after the pressure plate 16 has been released, the sliding member 12 can be taken out of the swivel frame 13. The closing member 11 is removed by means of a drawing-off device (of conventional design, not shown) which acts on the cams 19 of the drawing-off plate 10. Due to the fact that the drawing-off plate 10 surrounds the closing member 11 in the direction toward the bottom plate 3 of the ladle, the closing member 11 can be taken out of the bottom block 1 without difficulties. This is particularly true in the case of the horizontally arranged gap 20 between the bottom block 1 and the closing member 11, since, in this case, the drawing force to be applied is not very high. It can be seen that the new wearing parts 11 and 12 can be inserted without difficulties. Above all, such auxiliary means as, for example, templates and gauges as they are necessary in most conventional arrangements are not required.

What is claimed is:

1. A closure arrangement for a ladle which enables molten metal in the ladle to be discharged from the bottom of the ladle, the bottom of the ladle extending in a given plane, comprising a bottom block extending through the bottom of the ladle, said bottom block having an aperture for discharging molten metal in the ladle, a refractory closing member having a first planar sealing surface which is generally kidney-shaped, said closing member has a wall the outer surface of which extends generally conically from said first sealing surface, and an aperture in alignment with the aperture in said bottom block for discharging the molten metal, a drawing off plate fixed below said bottom block and in engagement with said closing member in the region of said first sealing surface for seating said closing member so that said first sealing surface faces away from said bottom block and extends in a plane parallel to the bottom of the ladle, a centering ring fixed between said bottom block and said drawing off plate for guiding said closing member so that said wall of said closing member extends at least partially into said bottom block, a cantilever frame arranged at the bottom of the ladle and a pivot pin fixed beneath the bottom of the ladle for supporting said cantilever frame for swinging movement relative to said closing member in a plane parallel to the bottom of the ladle, a refractory sliding member mounted in said cantilever frame for adjustable movement in the direction perpendicular to the plane of the bottom of the ladle, said sliding member has a second planar sealing surface which is generally kidney-shaped and faces toward said first sealing surface, and a pressure plate supported on said cantilever frame for urging said sliding member toward said closing member so that said first and said second sealing surfaces are in sealing relationship as said cantilever frame swings said sliding member against said closing member over a certain range wherein said sliding member blocks the discharge of the molten metal through said bottom block and said closing member.

2. A closure arrangement according to claim 1, wherein said bottom block and said closing member confront one another to define a gap which extends in a plane parallel to the plane of the bottom of the ladle, and the aperture in said bottom block is of larger cross-section than that of the aperture in said closing member.

3. A closure arrangement according to claim 1, wherein said first sealing surface of said closing member is of larger area than that of said second sealing surface of said sliding member.

4. A closure arrangement according to claim 1, including a metal jacket surrounding said outer surfaces of said wall of said closing member.

5. A closure arrangement according to claim 1, wherein said pressure plate includes a number of screws and a number of springs for urging said sliding member against said closing member.

6. A closure arrangement according to claim 1, wherein said cantilever frame has an associated rack, and further comprising a removably mountable gear system having a spur gear in meshed engagement with said rack.

7. A closure arrangement according to claim 6, including means responsive to compressed air for driving said gear system.

* * * * *